US012123621B2

(12) United States Patent
Thobias et al.

(10) Patent No.: US 12,123,621 B2
(45) **Date of Patent: *Oct. 22, 2024**

(54) HIGH-PERFORMANCE HOUSINGS FOR BACKWARD-CURVED BLOWERS

(71) Applicant: Lennox Industries Inc., Richardson, TX (US)

(72) Inventors: Patric Ananda Balan Thobias, Chennai (IN); Amit Parsai, Chennai (IN); Shiliang Wang, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/512,169

(22) Filed: Nov. 17, 2023

(65) Prior Publication Data

US 2024/0085037 A1 Mar. 14, 2024

Related U.S. Application Data

(62) Division of application No. 17/230,037, filed on Apr. 14, 2021, now Pat. No. 11,885,526.

(51) Int. Cl.

| | |
|---|---|
| ***F24F 7/06*** | (2006.01) |
| ***F04D 25/08*** | (2006.01) |
| ***F04D 29/28*** | (2006.01) |
| ***F04D 29/42*** | (2006.01) |
| ***F24F 7/007*** | (2006.01) |
| ***F24F 7/08*** | (2006.01) |

(Continued)

(52) U.S. Cl.

CPC ..... *F24F 7/06* (2013.01); *F04D 25/08* (2013.01); *F04D 29/282* (2013.01); *F04D 29/4226* (2013.01); *F24F 7/007* (2013.01); *F24F 7/08* (2013.01); *F24F 11/74* (2018.01); *F24F 13/20* (2013.01); *F24F 2013/205* (2013.01)

(58) Field of Classification Search

CPC .. F04D 29/4226; F24F 13/20; F24F 2013/205

See application file for complete search history.

(56) References Cited

U.S. PATENT DOCUMENTS 2,857,747 A 10/1958 MacCracken et al.
4,565,075 A * 1/1986 Drucker ..... F24F 13/0236 165/122
2005/0042107 A1 2/2005 Liu et al.

FOREIGN PATENT DOCUMENTS

EP 2336574 A1 6/2011

* cited by examiner

*Primary Examiner* — Brian O Peters

(57) ABSTRACT

In an embodiment, a blower for a heating, ventilation, and air conditioning system includes a blower wheel and a housing. The blower wheel includes backward-curved blades configured to rotate in a rotational plane. The housing forms an at least hexagonal cross-section around at least a portion of the rotational plane, where the blower wheel is positioned within the housing such that there exists a first distance and a second distance. The first distance is measured radially outward from a center of the blower wheel to a first side of the at least hexagonal cross-section. The second distance is measured radially outward from the center of the blower wheel to a second side of the at least hexagonal cross-section. The second distance forms a an acute angle with the first distance. The first distance and the second distance are unequal and less than a diameter of the blower wheel.

20 Claims, 14 Drawing Sheets

(51) Int. Cl.
*F24F 11/74* (2018.01)
*F24F 13/20* (2006.01)

HIGH-PERFORMANCE HOUSINGS FOR BACKWARD-CURVED BLOWERS

CROSS-REFERENCE TO RELATED APPLICATIONS

This application is a divisional of U.S. patent application Ser. No. 17/230,037, filed on Apr. 14, 2021. U.S. patent application Ser. No. 17/230,037 is incorporated herein by reference.

TECHNICAL FIELD

The present disclosure relates generally to a heating, ventilation, and air conditioning (HVAC) system and more particularly, but not by way of limitation, to housings for backward-curved blowers.

BACKGROUND

HVAC systems include fans or blowers (e.g., that include blower wheels) that circulate air between the HVAC system and an enclosed space associated with the HVAC system. Some fans and blowers are designed to operate at different speeds so that conditioned air can be supplied to the enclosed space at different flow rates. For example, in multi-zone systems, less air flow is needed to supply one zone of the multi-zone system with conditioned air as compared to supplying conditioned air to two or more zones of the multi-zone system. The airflow from the fan or blower is varied by supplying the fan or blower with different amounts of power. For example, reducing the amount of power supplied to the fan or blower reduces the speed of the fan or blower and increasing the amount of power supplied to the fan or blower increases the speed of the fan or blower. While adjusting the amount of power supplied to the blower helps tailor the amount of airflow produced by the blower, increasing fan speed can result in operating conditions that are inefficient.

SUMMARY

In an embodiment, a blower for a heating, ventilation, and air conditioning system includes a blower wheel and a housing. The blower wheel includes backward-curved blades configured to rotate in a rotational plane. The housing forms an at least hexagonal cross-section around at least a portion of the rotational plane, where the blower wheel is positioned within the housing such that there exists a first distance and a second distance. The first distance is measured radially outward from a center of the blower wheel to a first side of the at least hexagonal cross-section. The second distance is measured radially outward from the center of the blower wheel to a second side of the at least hexagonal cross-section. The second distance forms a first angle with the first distance, the first angle being an acute angle. The first distance and the second distance are unequal and less than a diameter of the blower wheel.

In an embodiment, a method of assembling a blower includes providing a housing and a blower wheel. The blower wheel includes backward-curved blades configured to rotate in a rotational plane. The method also includes positioning the blower wheel in the housing such that the housing forms an at least hexagonal cross-section around at least a portion of the rotational plane and such that there exists a first distance and a second distance. The first distance is measured radially outward from a center of the blower wheel to a first side of the at least hexagonal cross-section. The second distance is measured radially outward from the center of the blower wheel to a second side of the at least hexagonal cross-section. The second distance forms a first angle with the first distance, the first angle being an acute angle. The first distance and the second distance are unequal and less than a diameter of the blower wheel.

In an embodiment, a heating, ventilation, and air conditioning system includes an evaporator coil and a blower coupled to the evaporator coil. The blower includes a blower wheel and a housing. The blower wheel includes backward-curved blades configured to rotate in a rotational plane. The housing forms an at least hexagonal cross-section around at least a portion of the rotational plane, where the blower wheel is positioned within the housing such that there exists a first distance and a second distance. The first distance is measured radially outward from a center of the blower wheel to a first side of the at least hexagonal cross-section. The second distance is measured radially outward from the center of the blower wheel to a second side of the at least hexagonal cross-section. The second distance forms a first angle with the first distance, the first angle being an acute angle. The first distance and the second distance are unequal and less than a diameter of the blower wheel.

DETAILED DESCRIPTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

Figure 1:
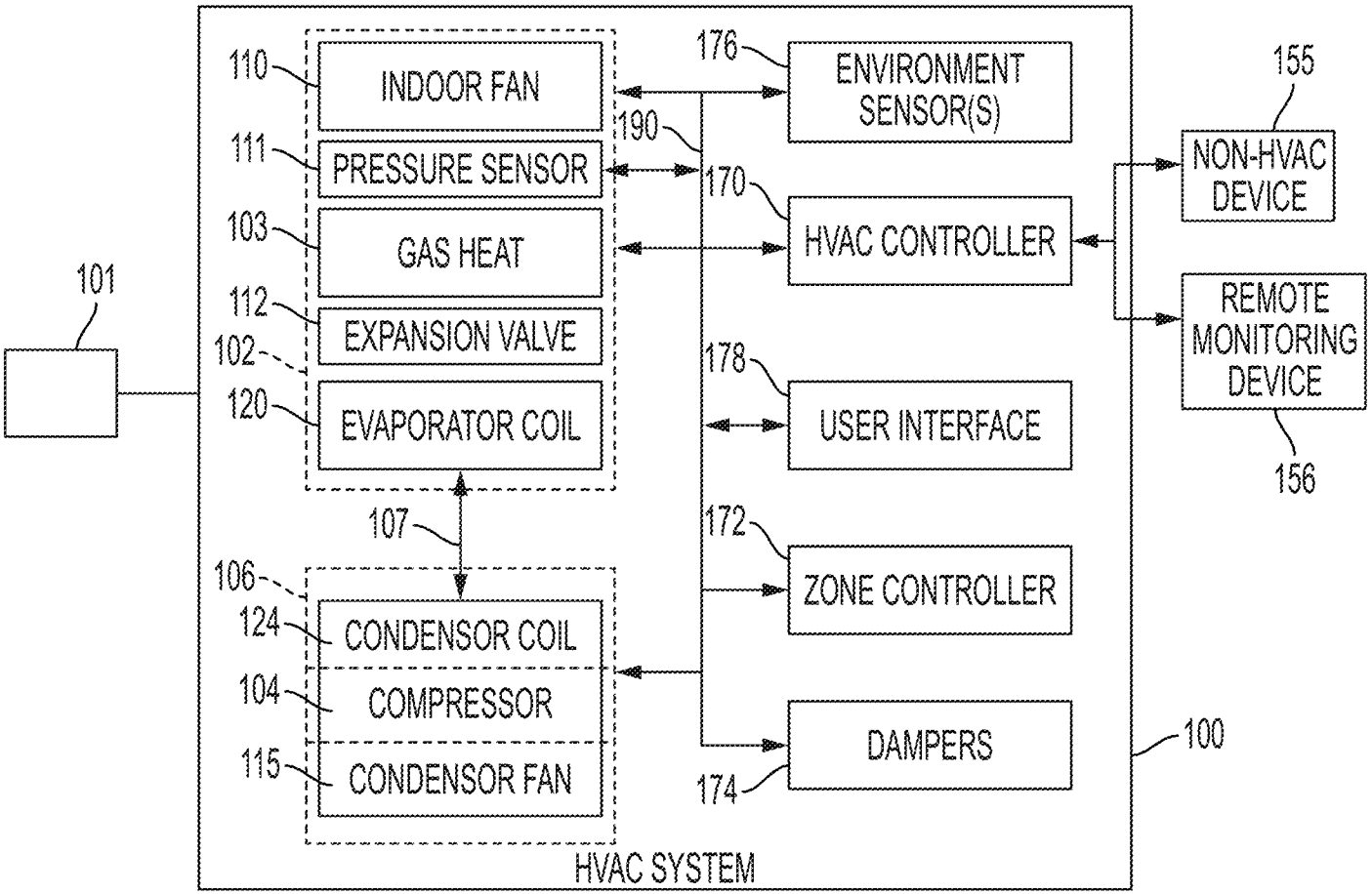
FIG. 1 is a block diagram of an illustrative HVAC system.

FIG. 1 illustrates an HVAC system 100. HVAC system 100 is configured to condition air via, for example, heating, cooling, humidifying, or dehumidifying air within an enclosed space 101. In a typical embodiment, enclosed space 101 is, for example, a house, an office building, a warehouse, and the like. Thus, HVAC system 100 can be a residential system or a commercial system such as, for example, a rooftop system. HVAC system 100 includes various components; however, in other embodiments, HVAC system 100 may include additional components that are not illustrated but typically included within HVAC systems.

HVAC system 100 includes an indoor fan or blower 110, a gas heat 103 typically associated with blower 110, and an evaporator coil 120, also typically associated with blower 110. For the purposes of this disclosure, gas heat 103 is a single-stage gas furnace. HVAC system 100 includes an expansion valve 112. Expansion valve 112 may be a thermal expansion valve or an electronic expansion valve. Blower 110, gas heat 103, expansion valve 112, and evaporator coil 120 are collectively referred to as an indoor unit 102. In a typical embodiment, indoor unit 102 is located within, or in close proximity to, enclosed space 101. HVAC system 100 also includes a compressor 104, an associated condenser coil 124, and an associated condenser fan 115, which are collectively referred to as an outdoor unit 106. In various embodiments, outdoor unit 106 and indoor unit 102 are, for example, a rooftop unit or a ground-level unit. Compressor 104 and associated condenser coil 124 are connected to evaporator coil 120 by a refrigerant line 107. Refrigerant line 107 includes, for example, a plurality of copper pipes that connect condenser coil 124 and compressor 104 to evaporator coil 120. Compressor 104 may be, for example, a single-stage compressor, a multi-stage compressor, a single-speed compressor, or a variable-speed compressor. Blower 110 is configured to operate at different capacities (e.g., variable motor speeds) to circulate air through HVAC system 100, whereby the circulated air is conditioned and supplied to enclosed space 101. Blower 110 operates at different speeds depending on the demand. Blower 110 operates at lower speeds for lower demands and at higher speeds for higher demands. In some embodiments, indoor unit 102 includes a pressure sensor 111 that measures static pressure at an exit of blower 110. Pressure sensor 111 may be any of a variety of pressure sensor types, such as a pressure transmitter, magnehelic gauge, and the like. Static pressure describes the air resistance that blower 110 operates against. The static pressure is the result of numerous aspects of the HVAC system, such as, for example, the size and length of the ductwork in the system. HVAC system 100 includes an expansion valve 112. Expansion valve 112 may be a thermal expansion valve or an electronic expansion valve.

Still referring to FIG. 1, HVAC system 100 includes an HVAC controller 170 configured to control operation of the various components of HVAC system 100 such as, for example, blower 110, gas heat 103, and compressor 104 to regulate the environment of enclosed space 101. In some embodiments, HVAC system 100 can be a zoned system. HVAC system 100 includes a zone controller 172, dampers 174, and a plurality of environment sensors 176. In a typical embodiment, HVAC controller 170 cooperates with zone controller 172 and dampers 174 to regulate the environment of enclosed space 101.

HVAC controller 170 may be an integrated controller or a distributed controller that directs operation of HVAC system 100. HVAC controller 170 includes an interface to receive, for example, thermostat calls, temperature setpoints, blower control signals, environmental conditions, and operating mode status for various zones of HVAC system 100. The environmental conditions may include indoor temperature and relative humidity of enclosed space 101. In a typical embodiment, HVAC controller 170 also includes a processor and a memory to direct operation of HVAC system 100 including, for example, a speed of blower 110.

Still referring to FIG. 1, in some embodiments, the plurality of environment sensors 176 are associated with HVAC controller 170 and also optionally associated with a user interface 178. The plurality of environment sensors 176 provides environmental information within a zone or zones of enclosed space 101 such as, for example, temperature and/or humidity of enclosed space 101 to HVAC controller 170. The plurality of environment sensors 176 may also send the environmental information to a display of user interface 178. In some embodiments, user interface 178 provides additional functions such as, for example, operational, diagnostic, status message display, and a visual interface that allows at least one of an installer, a user, a support entity, and a service provider to perform actions with respect to HVAC system 100. In some embodiments, user interface 178 is, for example, a thermostat. In other embodiments, user interface 178 is associated with at least one sensor of the plurality of environment sensors 176 to determine the environmental condition information and communicate that information to the user. User interface 178 may also include a display, buttons, a microphone, a speaker, or other components to communicate with the user. Additionally, user interface 178 may include a processor and memory configured to receive user-determined parameters such as, for example, a relative humidity of enclosed space 101 and to calculate operational parameters of HVAC system 100 as disclosed herein.

HVAC system 100 is configured to communicate with a plurality of devices such as, for example, a monitoring device 156, a communication device 155, and the like. In a typical embodiment, and as shown in FIG. 1, monitoring device 156 is not part of HVAC system 100. For example, monitoring device 156 is a server or computer of a third party such as, for example, a manufacturer, a support entity, a service provider, and the like. In some embodiments, monitoring device 156 is located at an office of, for example, the manufacturer, the support entity, the service provider, and the like.

In a typical embodiment, communication device 155 is a non-HVAC device having a primary function that is not associated with HVAC systems. For example, non-HVAC devices include mobile-computing devices configured to interact with HVAC system 100 to monitor and modify at least some of the operating parameters of HVAC system 100. Mobile computing devices may be, for example, a personal computer (e.g., desktop or laptop), a tablet computer, a mobile device (e.g., smart phone), and the like. In a typical embodiment, communication device 155 includes at least one processor, memory, and a user interface such as a display. One skilled in the art will also understand that communication device 155 disclosed herein includes other components that are typically included in such devices including, for example, a power supply, a communications interface, and the like.

Zone controller 172 is configured to manage movement of conditioned air to designated zones of enclosed space 101. Each of the designated zones includes at least one conditioning or demand unit such as, for example, gas heat 103 and user interface 178, only one instance of user interface 178 being expressly shown in FIG. 1, such as, for example, the thermostat. HVAC system 100 allows the user to independently control the temperature in the designated zones. In a typical embodiment, zone controller 172 operates dampers 174 to control air flow to the zones of enclosed space 101.

A data bus 190, which in the illustrated embodiment is a serial bus, couples various components of HVAC system 100 together such that data is communicated therebetween. Data bus 190 may include, for example, any combination of hardware, software embedded in a computer readable medium, or encoded logic incorporated in hardware or otherwise stored (e.g., firmware) to couple components of HVAC system 100 to each other. As an example and not by way of limitation, data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local bus (VLB), or any other suitable bus or a combination of two or more of these. In various embodiments, data bus 190 may include any number, type, or configuration of data buses 190, where appropriate. In particular embodiments, one or more data buses 190 (which may each include an address bus and a data bus) may couple HVAC controller 170 to other components of HVAC system 100. In other embodiments, connections between various components of HVAC system 100 are wired. For example, conventional cable and contacts may be used to couple HVAC controller 170 to the various components. In some embodiments, a wireless connection is employed to provide at least some of the connections between components of HVAC system 100 such as, for example, a connection between HVAC controller 170 and blower 110 or the plurality of environment sensors 176.

Figure 2A:
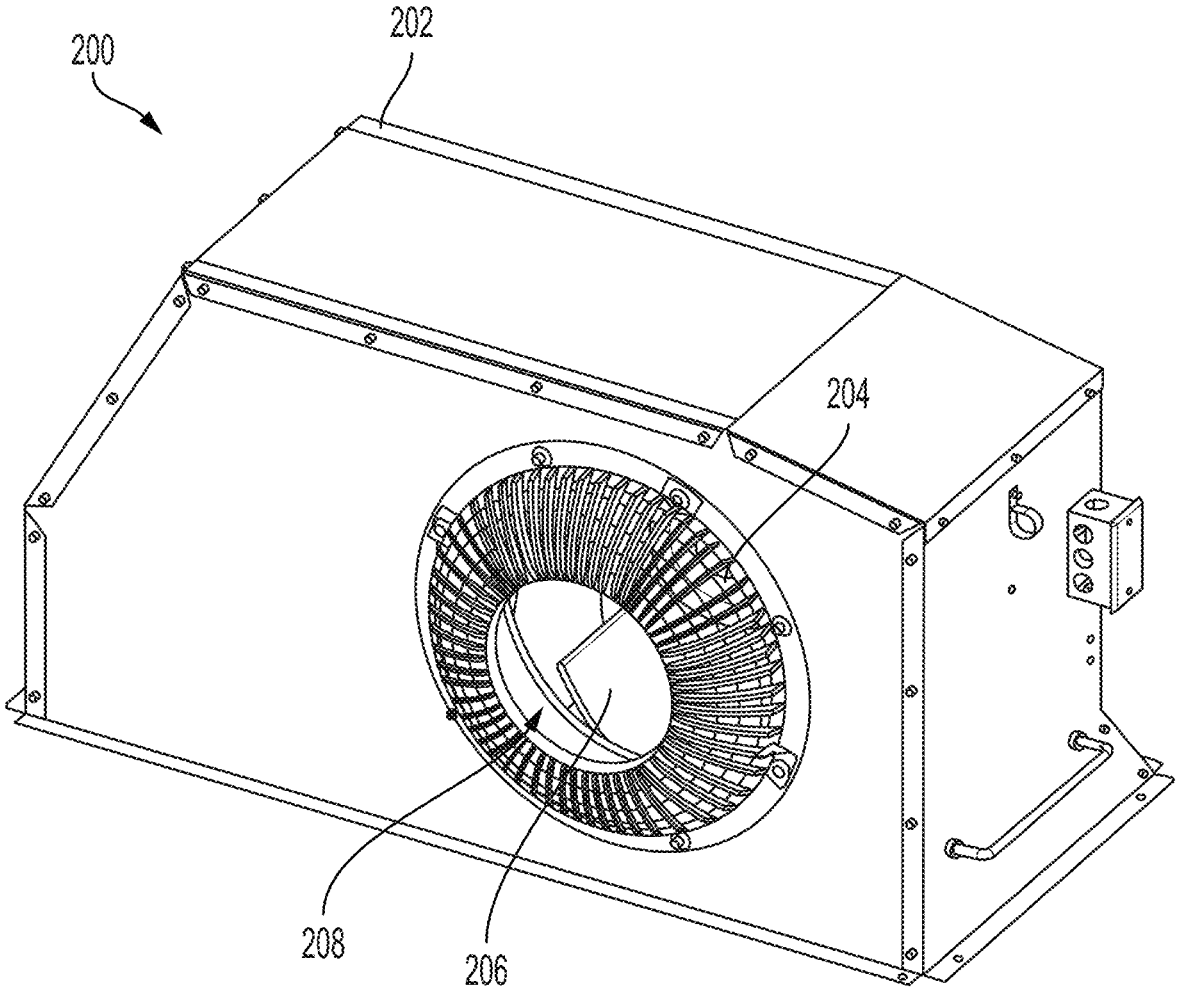
FIG. 2A illustrates a perspective view of a blower.
Figure 2B:
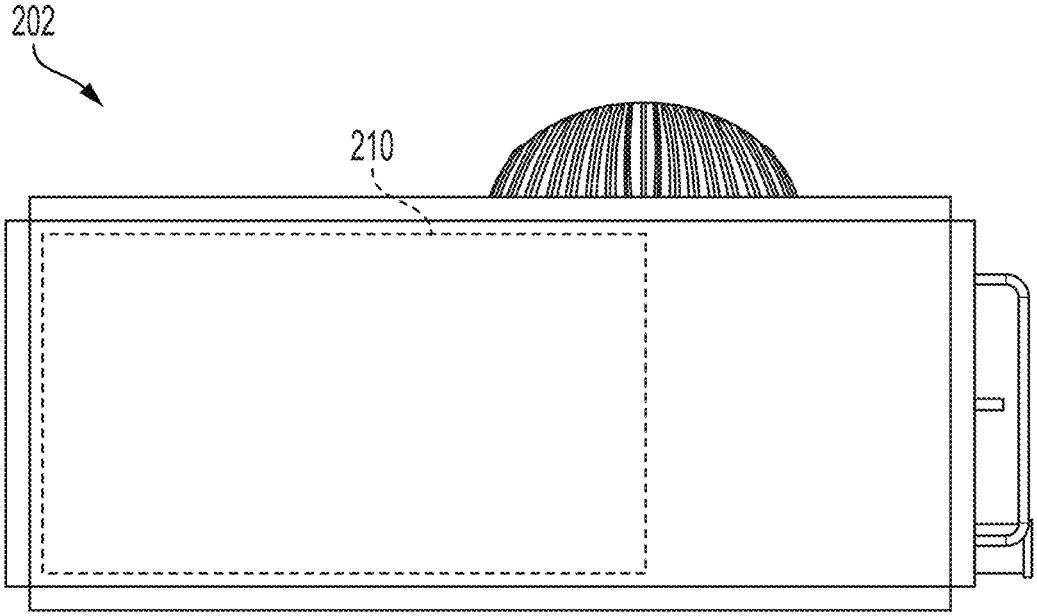
FIG. 2B illustrates a bottom view of a blower housing.

FIGS. 2A-B illustrate a blower 200 having a housing 202. In particular, FIG. 2A illustrates a perspective view of blower 200, while FIG. 2B illustrates a bottom view of the housing 202. Blower 200 may be incorporated into HVAC system 100 of FIG. 1, for example, as blower 110. With reference to FIGS. 2A-B together, blower 200 includes the housing 202, a motor 204, and a blower wheel 206. Motor 204 drives blower wheel 206, which rotates in its rotational plane to draw air in through an intake 208 and push air out through an outlet 210 disposed on a bottom of housing 202. In the illustrated embodiment, outlet 210 is shown to form a particular portion of the bottom of housing 202. However, outlet 210 is shown with dashed lines in order to illustrate that, in various embodiments, a size and shape of outlet 210 can be configurable to suit a given implementation. For example, in some embodiments, outlet 210 can form an entirety of the bottom of housing 202. In operation, air is pushed out through outlet 210 perpendicularly relative to a flow of air through intake 208. Outlet 210 is coupled, for example, to gas heat 103 and evaporator coil 120. In other aspects, gas heat 103 and evaporator coil 120 may be coupled to intake 208. Air from blower 200 circulates through gas heat 103 and evaporator coil 120 for heating and cooling, respectively, as needed and then circulates through enclosed space 101. Air from enclosed space 101 returns to indoor unit 102 via intake 208 of blower 200.

Figure 2C:
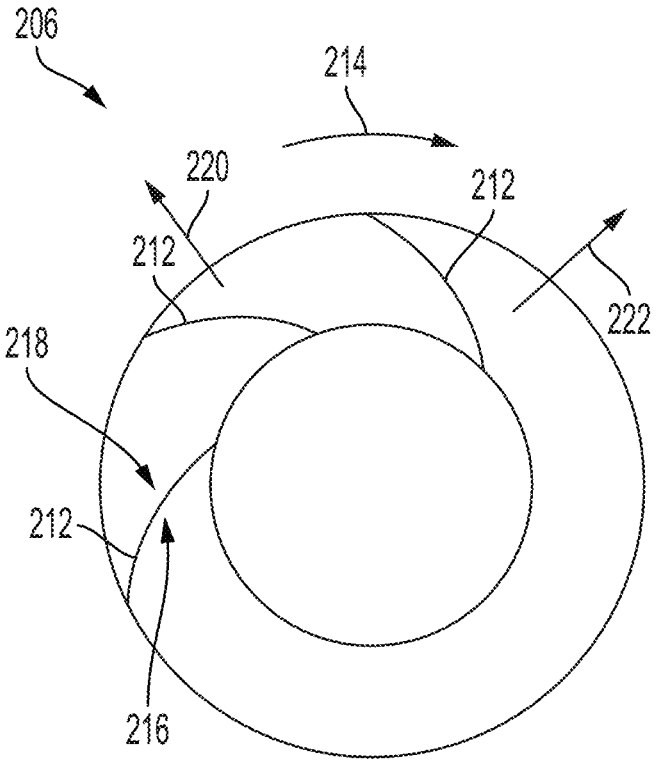
FIG. 2C illustrates a cross-sectional view of blower wheel.

FIG. 2C illustrates a cross-sectional view of blower wheel 206. As shown, blower wheel 206 includes backward-curved blades 212 that curve away from a direction 214 in which they rotate. For this reason, blower wheel 206 may be referred to as a backward-curved blower wheel and blower 200 may be referred to as a backward-curved blower. Backward-curved blades 212 each have a pressure side 216 and a suction side 218. As the blower wheel rotates in the direction 214, air exits the blower wheel 206 radially from each of the backward-curved blades 212, for example, as illustrated by arrows 220 and 222. Although three backward-curved blades 212 are labeled for simplicity, it should be appreciated that blower wheel 206 can include any suitable number of backward-curved blades 212.

With reference to FIGS. 2A-C collectively, blower 200 can be assembled in a fashion that improves overall blower efficiency. For example, housing 202 can be configurably manufactured such that, in cross-section relative to intake 208, it forms a shape of five, six, seven or more sides, where the cross-section at least partially surrounds blower wheel 206 and its rotational plane. In certain embodiments, interior dimensions of housing 202 can be configured as a function of a diameter of blower wheel 206 so as to optimize performance benefits of the multi-sided cross section. Particular examples will be described relative to FIG. 3.

Figure 3:
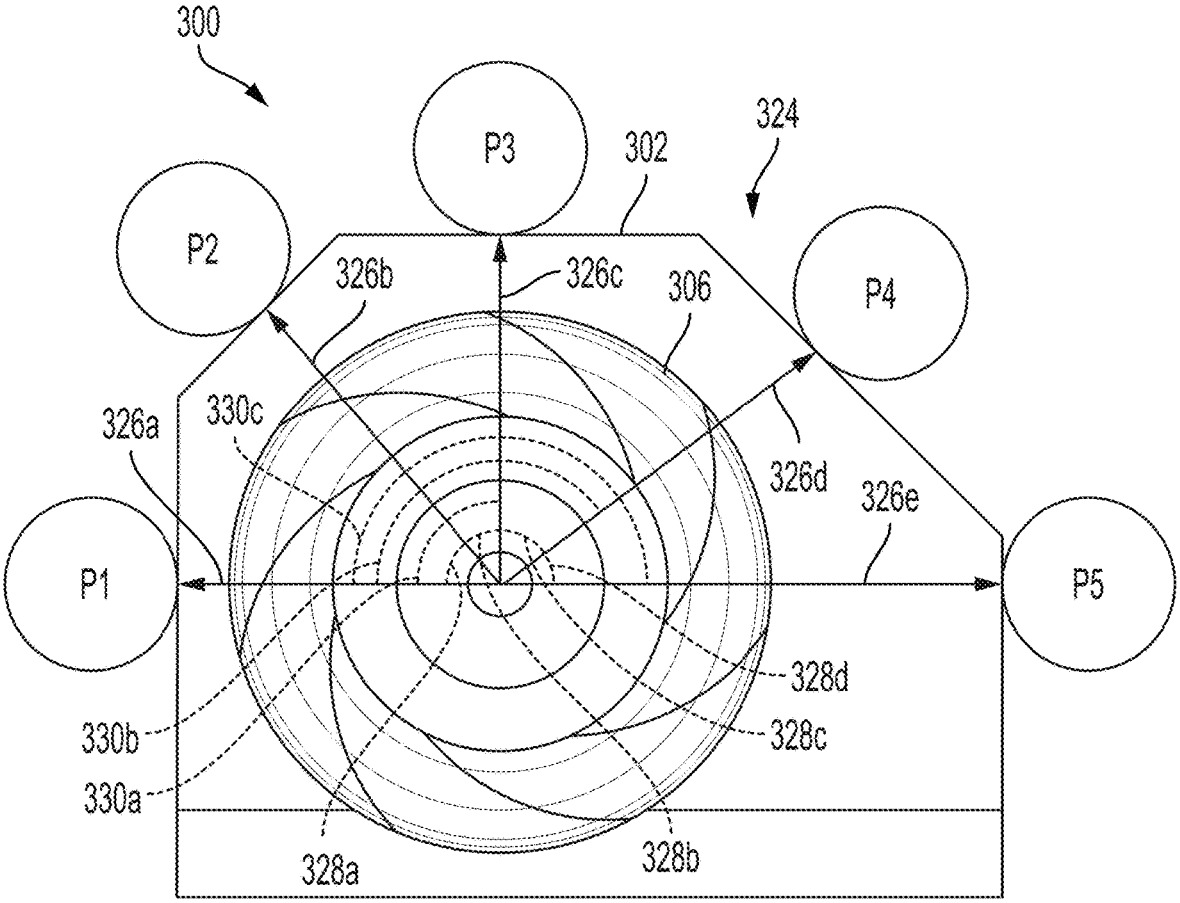
FIG. 3 illustrates a cross-sectional view of a blower 300 from an intake side thereof.
Figure 4A:
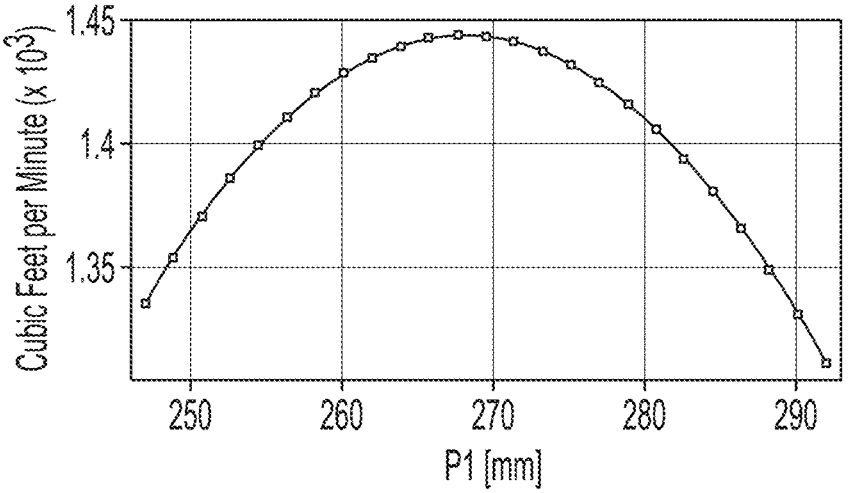
FIGS. 4A-E are graphs illustrating simulated performance of a blower.
Figure 4B:
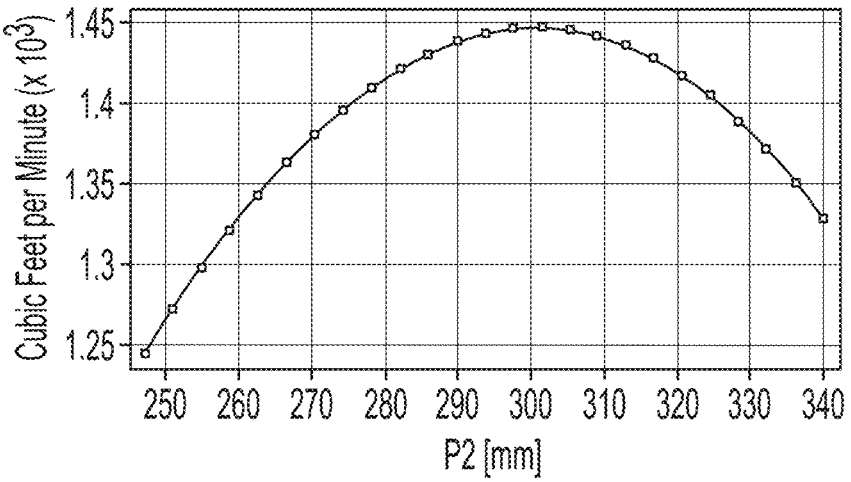
Figure 4C:
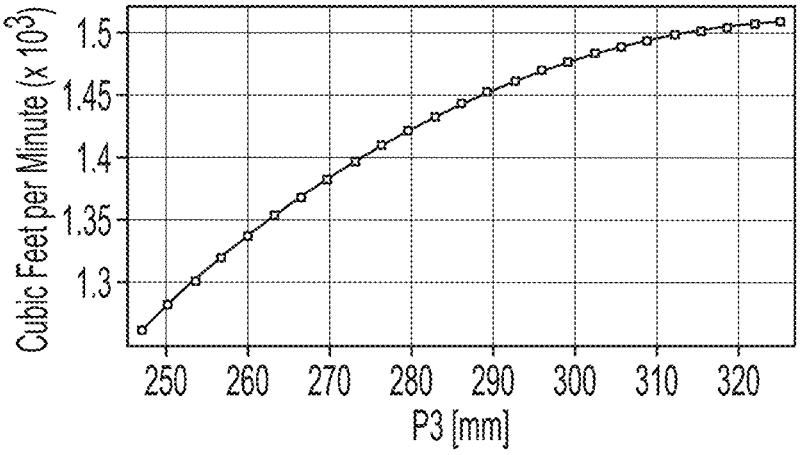
Figure 4D:
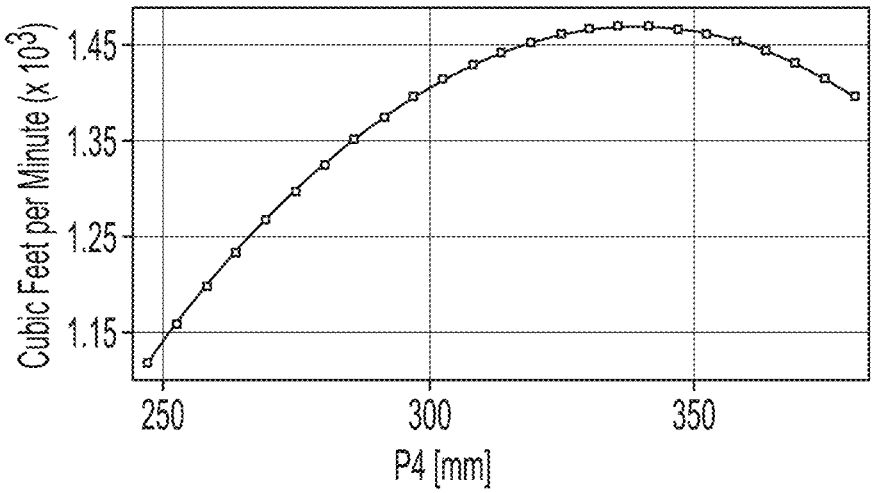
Figure 4E:
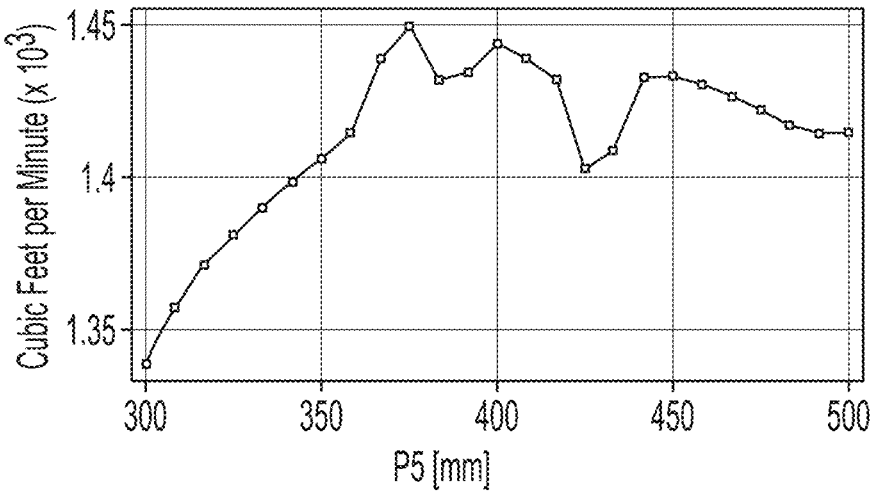

FIG. 3 illustrates a cross-sectional view of a blower 300 from an intake side thereof. Blower 300 includes housing 302 and blower wheel 306. In general, blower 300 and blower wheel 306 can operate as described relative to blower 200 and blower wheel 206, respectively, of FIGS. 2A-C. As illustrated, housing 302 forms cross-section 324 around at least a portion of a rotational plane of blower wheel 306.

More particularly, FIG. 3 illustrates configurable distance parameters 326*a*, 326*b*, 326*c*, 326*d* and 326*e* (collectively, distance parameters 326), which parameters are also referred to as P1, P2, P3, P4 and P5, respectively. In the illustrated embodiment, cross-section 324 is a hexagonal shape such that distance parameters 326 each define a distance measured radially outward from a center of blower wheel 306 to a different side of the hexagonal shape. In addition, or alternatively, distance parameters 326 can be at least partially defined according to angles formed with each other in cross-section 324. As described in greater detail below, blower 300 can be configurably manufactured and/or assembled in accordance with distance parameters 326.

In the illustrated embodiment, distance parameters 326 form angles 328*a*, 328*b*, 328*c* and 328*d* (collectively, angles 328) with each other. In particular, distance parameter 326*b* forms an angle 328*a* with distance parameter 326*a*, distance parameter 326*c* forms an angle 328*b* with distance parameter 326*b*, distance parameter 326*d* forms an angle 328*c* with distance parameter 326*c*, and distance parameter 326*e* forms an angle 328*d* with distance parameter 326*d*. It should be appreciated that distance parameters 326*b*, 326*c*, and 326*d* and 326*e* each form an angle with distance parameter 326*a*. As already stated, distance parameter 326*b* forms angle 328*a* with distance parameter 326*a*. Additionally, distance parameter 326*c* forms a cumulative angle 330*a* with distance parameter 326*a*, where cumulative angle 330*a* includes angles 328*a* and 328*b*. Similarly, distance parameter 326*d* forms a cumulative angle 330*b* with distance parameter 326*a*, where cumulative angle 330*b* includes angles 328*a*, 328*b* and 328*c*. In like fashion, distance parameter 326*e* forms a cumulative angle 330*c* with distance parameter 326*a*, where cumulative angle 330*c* includes angles 328*a*, 328*b*, 328*c* and 328*d*.

In some cases, angles 328 can each be acute angles of the same or different sizes. In one example, as illustrated in FIG. 3, angles 328 can each be approximately 45 degrees. According to this example, cumulative angle 330*a* would be an approximately right angle (i.e., 90 degrees), cumulative angle 330*b* would be an obtuse angle of approximately 135 degrees, and cumulative angle 330*c* would be approximately 180 degrees. One skilled in the art will appreciate that all angles shown in FIG. 3 can be configurably sized to suit a given implementation.

In certain embodiments, distance parameters 326 can be configured as a function of a diameter of blower wheel 306. In one example, distance parameters 326 can each define a distance approximately equal to a configurable value times the diameter of blower wheel 306. In some embodiments, the configurable value that is multiplied by the diameter of blower wheel 306 can be less than one, such that distance parameters 326 are each a proportion of the diameter of blower wheel 306. Table 1 below illustrates an example of ranges of values for distance parameters 326 as a function of the diameter of blower wheel 306. Table 2 below illustrates a second example of ranges of values for distance parameters 326 as a function of the diameter of blower wheel 306. In some embodiments, the narrower ranges of Table 2 produce performance improvements. Table 3 illustrates an example optimal profile for housing 302, where a specific formula is listed for each of distance parameters 326.

TABLE 1

| Parameter | Minimum | Maximum |
|---|---|---|
| P1 | 0.55 * Diameter | 0.7 * Diameter |
| P2 | 0.55 * Diameter | 0.8 * Diameter |
| P3 | 0.55 * Diameter | 0.8 * Diameter |
| P4 | 0.55 * Diameter | 0.87 * Diameter |
| P5 | 0.7 * Diameter | 1.14 * Diameter |

TABLE 2

| Parameter | Minimum | Maximum |
|---|---|---|
| P1 | 0.55 * Diameter | 0.57 * Diameter |
| P2 | 0.73 * Diameter | 0.75 * Diameter |
| P3 | 0.72 * Diameter | 0.8 * Diameter |
| P4 | 0.84 * Diameter | 0.86 * Diameter |
| P5 | 0.89 * Diameter | 0.91 * Diameter |

TABLE 3

| Example Optimal Profile | |
|---|---|
| Parameter | Value |
| P1 | 0.55 * Diameter |
| P2 | 0.73 * Diameter |
| P3 | 0.72 * Diameter |
| P4 | 0.84 * Diameter |
| P5 | 0.89 * Diameter |

FIGS. 4A-E are graphs illustrating simulated performance of a blower, such as blower 300 of FIG. 3, for different values of distance parameters 326. FIGS. 4A-E each depict performance in cubic feet per minute (CFM). With reference to FIG. 3 and Tables 1-3, FIGS. 4A, 4B, 4C, 4D, and 4E correspond to P1, P2, P3, P4, and P5, respectively. The diameter can be any suitable value (e.g., 453 mm).

Figure 5A:
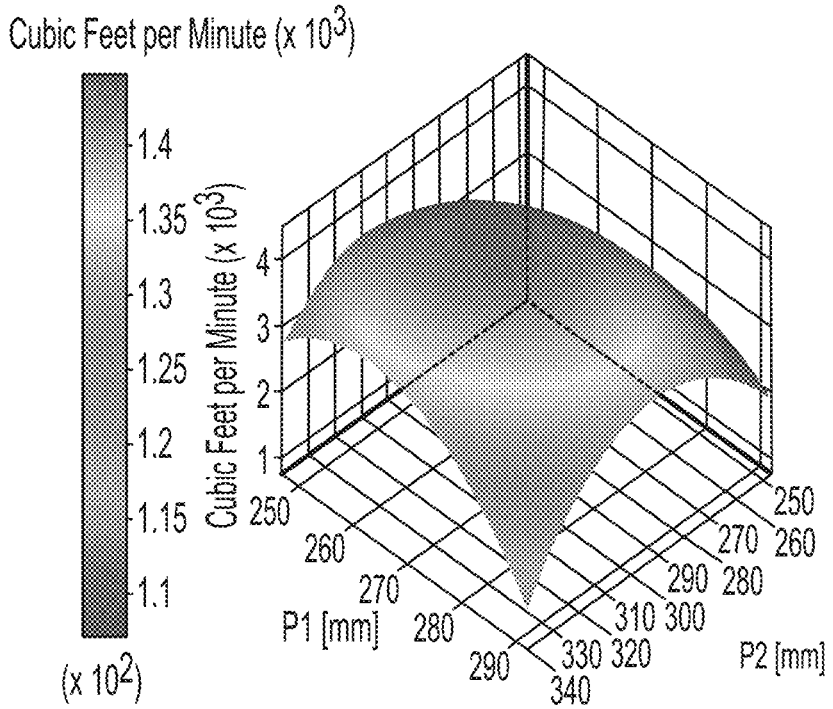
FIGS. 5A-J are three-dimensional graphs illustrating simulated performance of a blower.
Figure 5B:
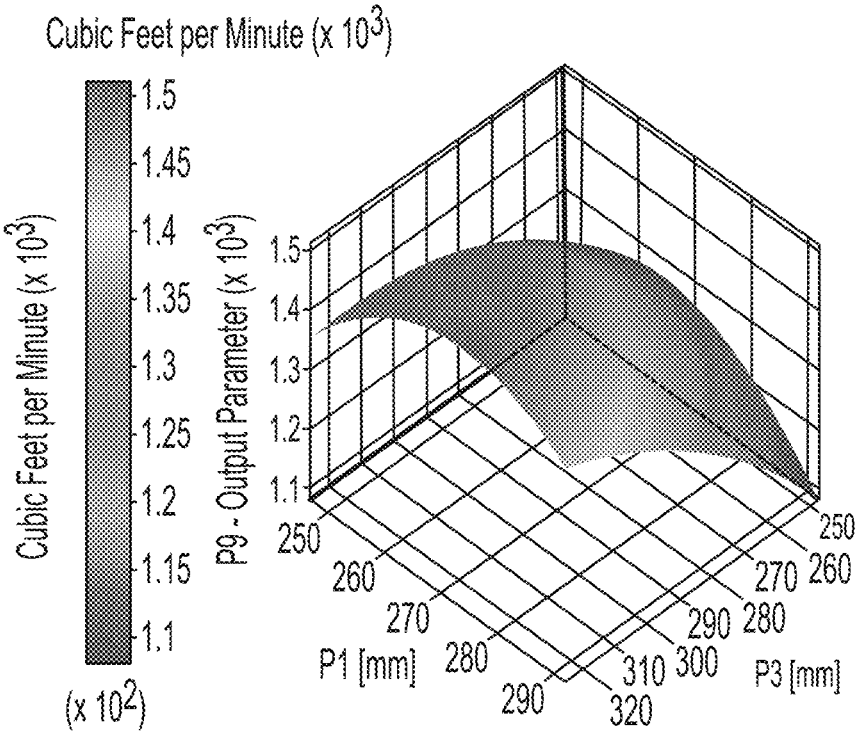
Figure 5C:
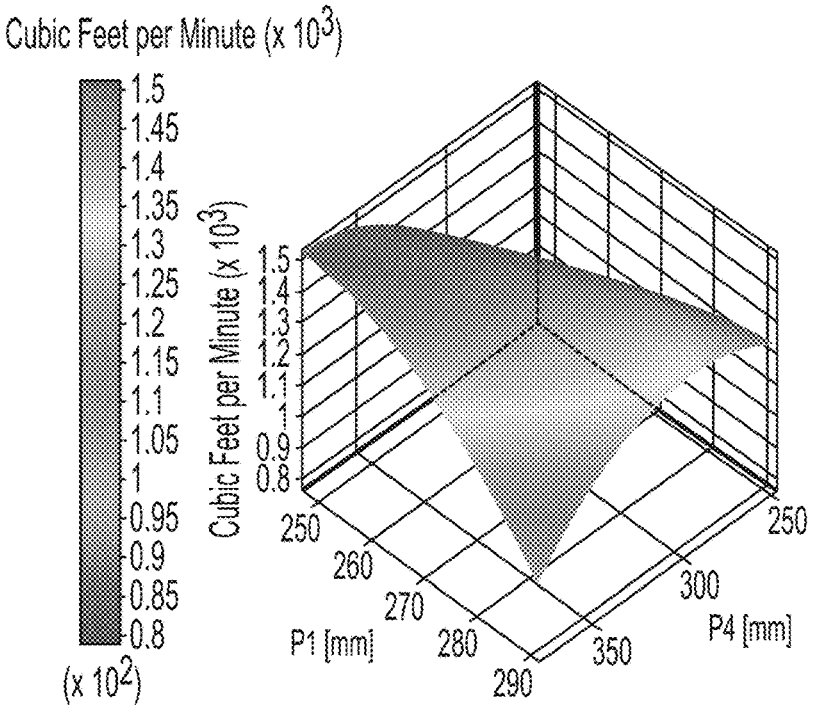
Figure 5D:
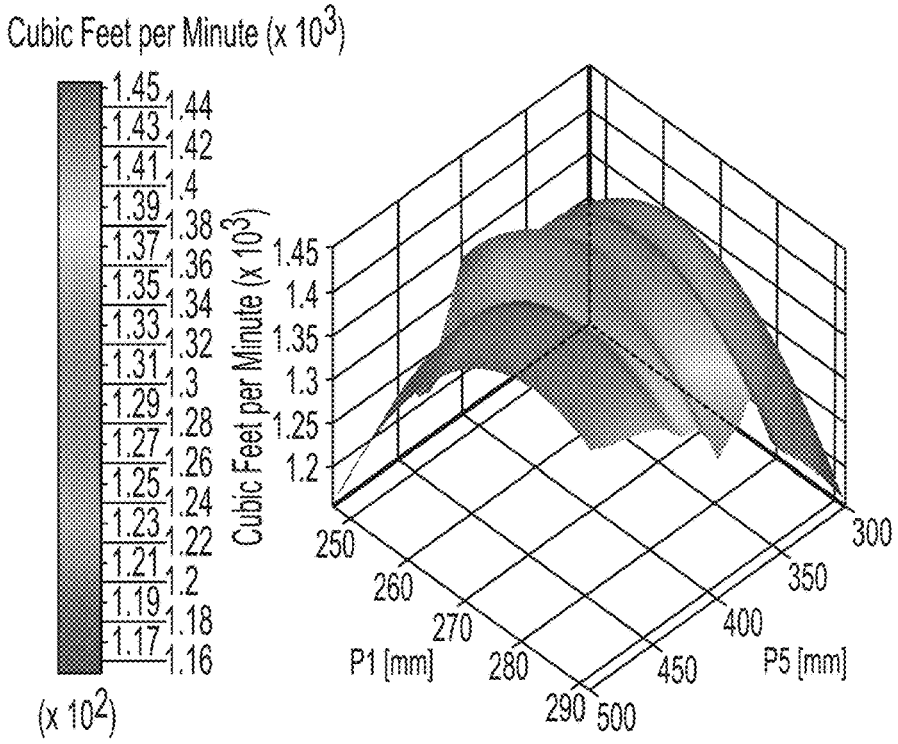
Figure 5E:
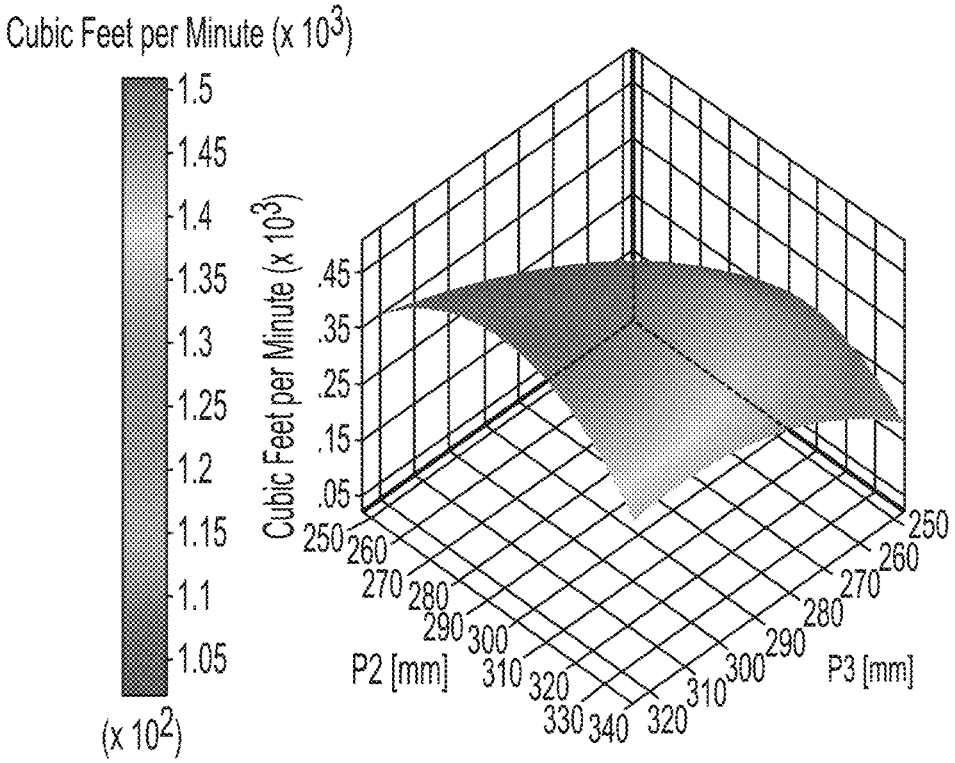
Figure 5F:
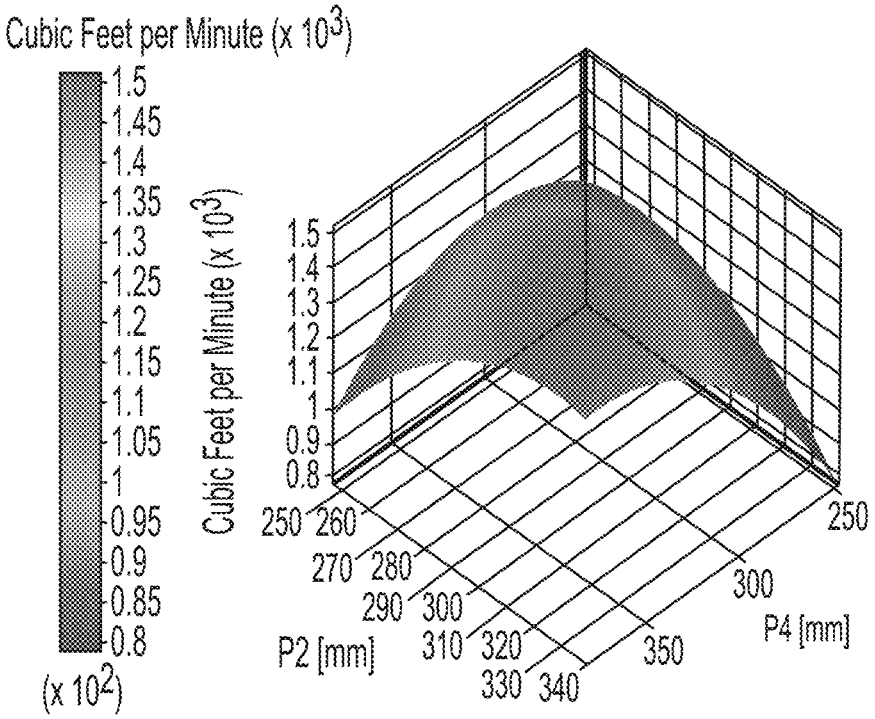
Figure 5G:
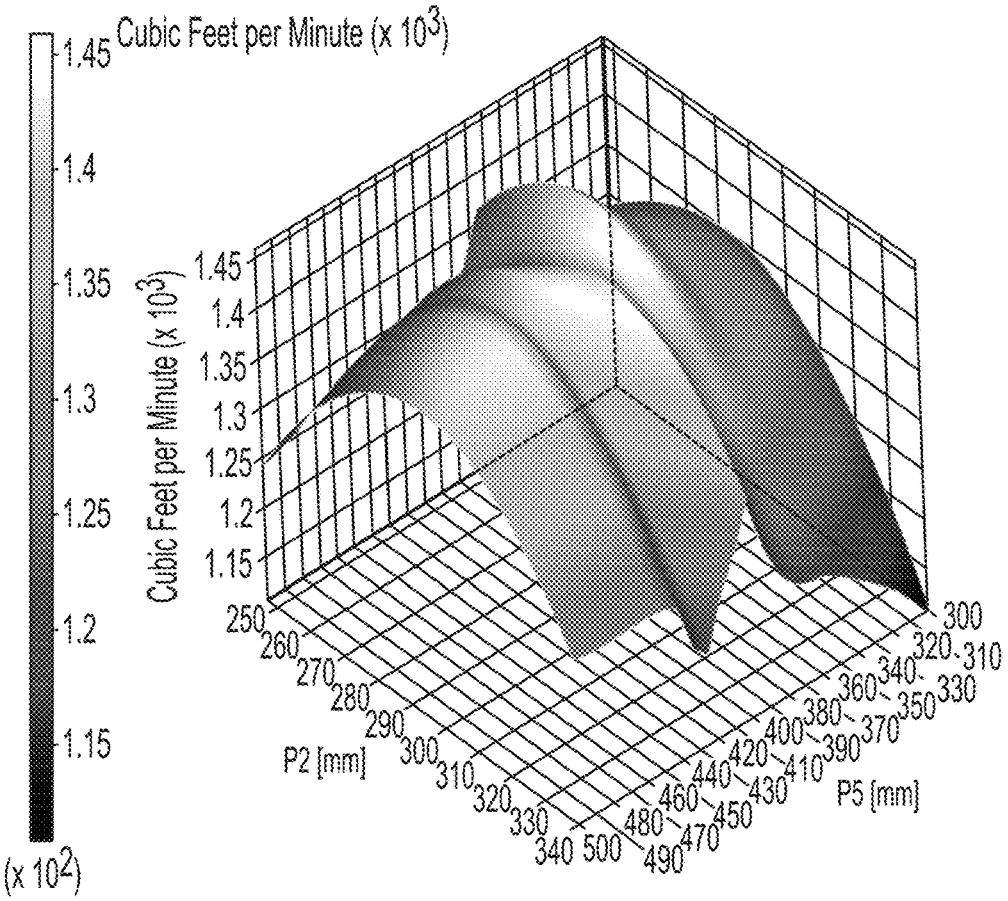
Figure 5H:
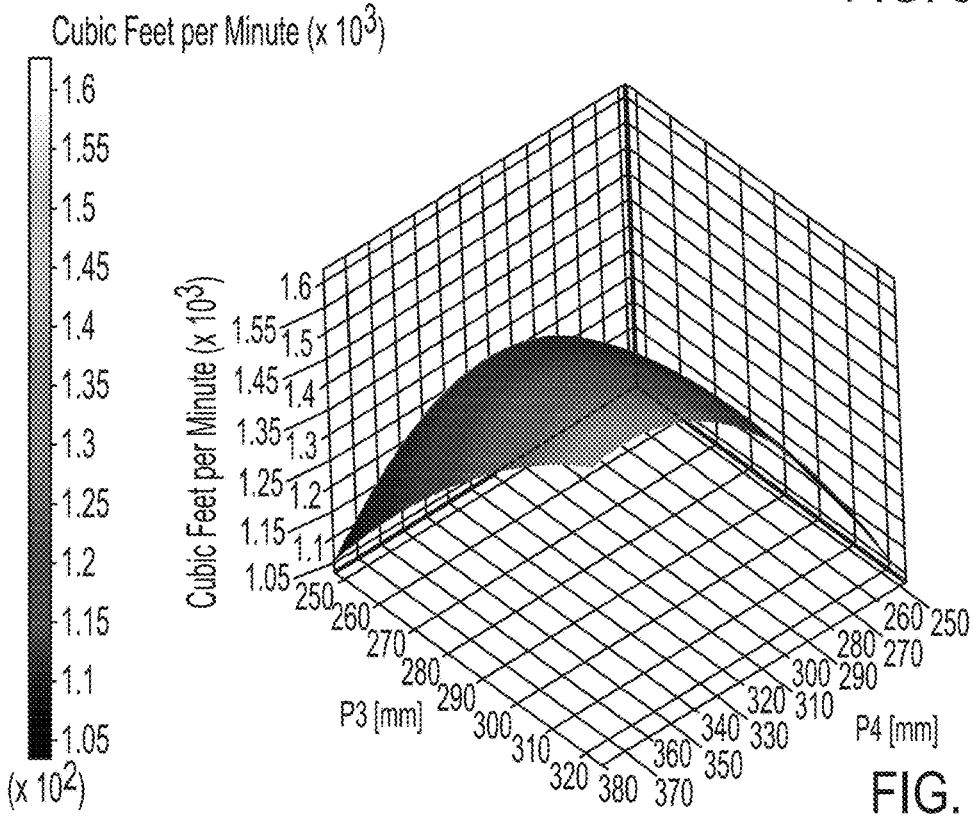
Figure 5I:
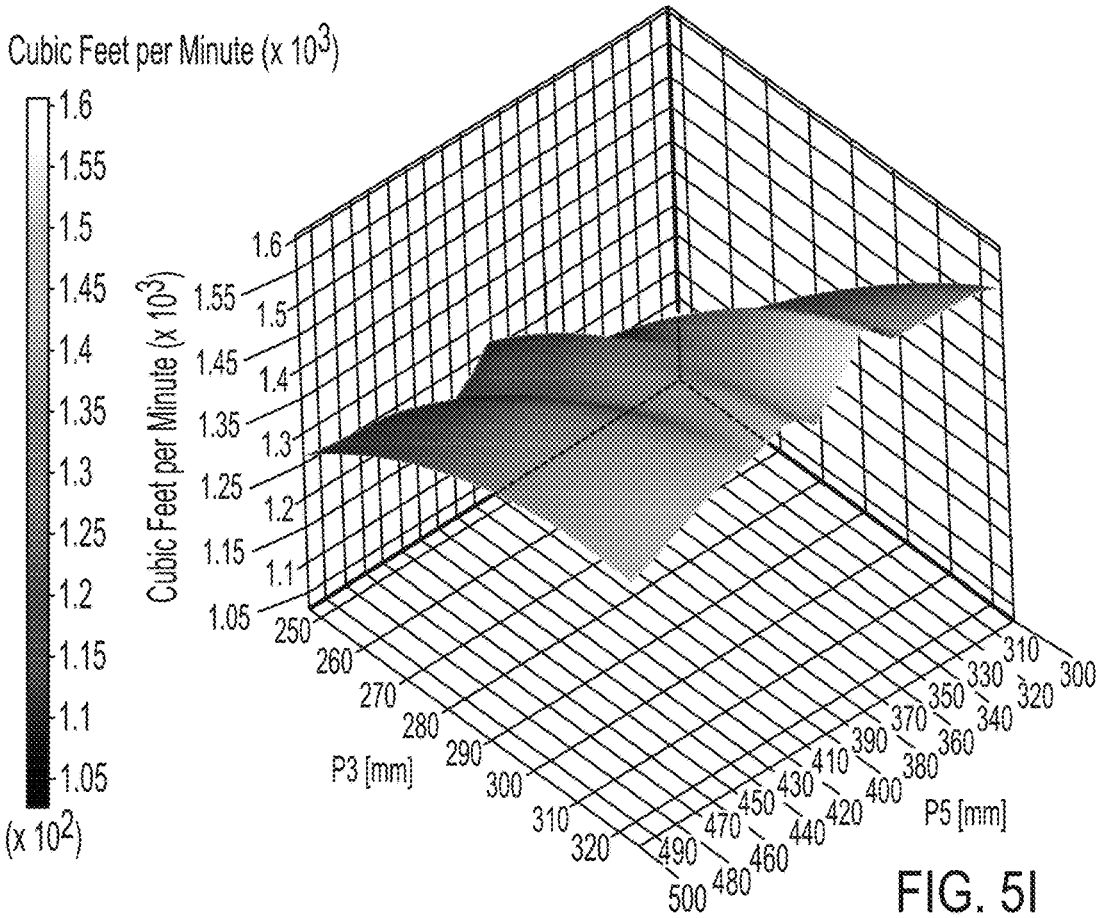
Figure 5J:
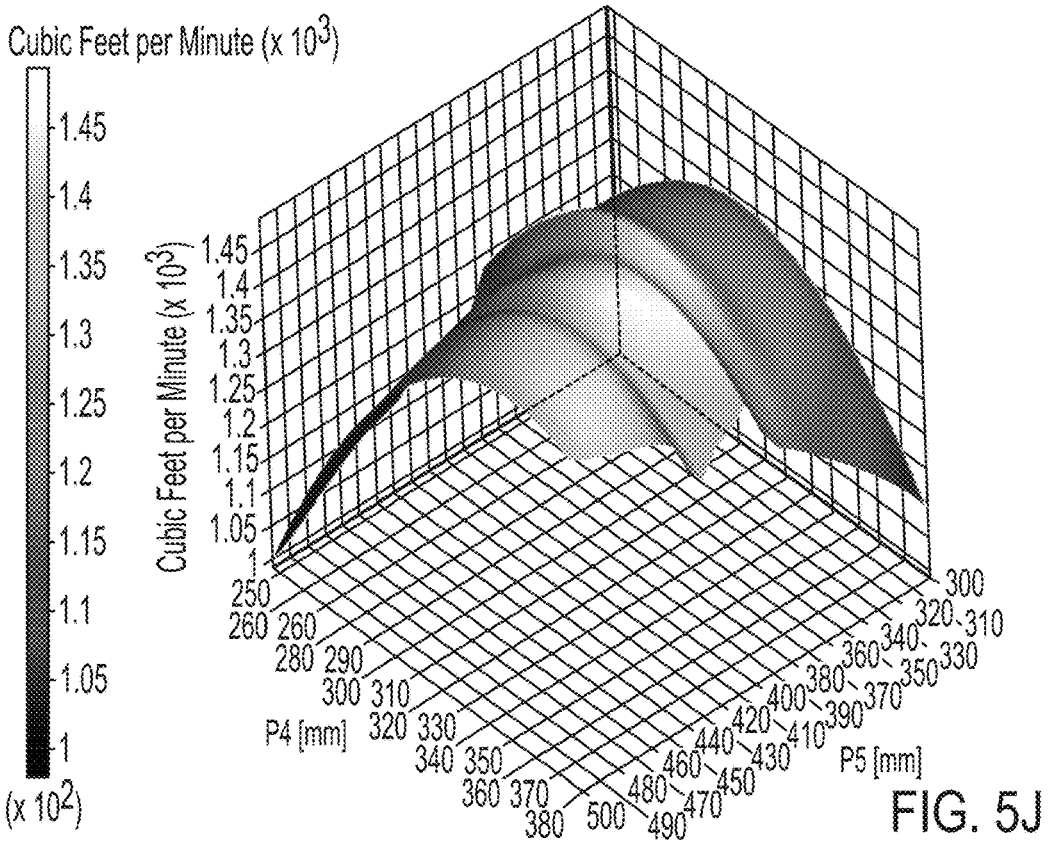

FIGS. 5A-J are three-dimensional graphs illustrating simulated performance of an example blower, such as blower 300 of FIG. 3, for different combinations of values of distance parameters 326. FIGS. 5A-J each depict performance in CFM. With reference to FIG. 3 and Tables 1-3, FIGS. 5A, 5B, 5C and 5D illustrate variation in performance for P1 in combination with P2, P1 in combination with P3, P1 in combination with P4, and P1 in combination with P5, respectively. FIGS. 5E, 5F and 5G illustrate variation in performance for P2 in combination with P3, P2 in combination with P4, and P2 in combination with P5, respectively. FIGS. 5H and SI illustrate variation in performance for P3 in combination with P4 and for P3 in combination with P5, respectively. FIG. 5J illustrates variation in performance for P4 in combination with P5.

Figure 6A:
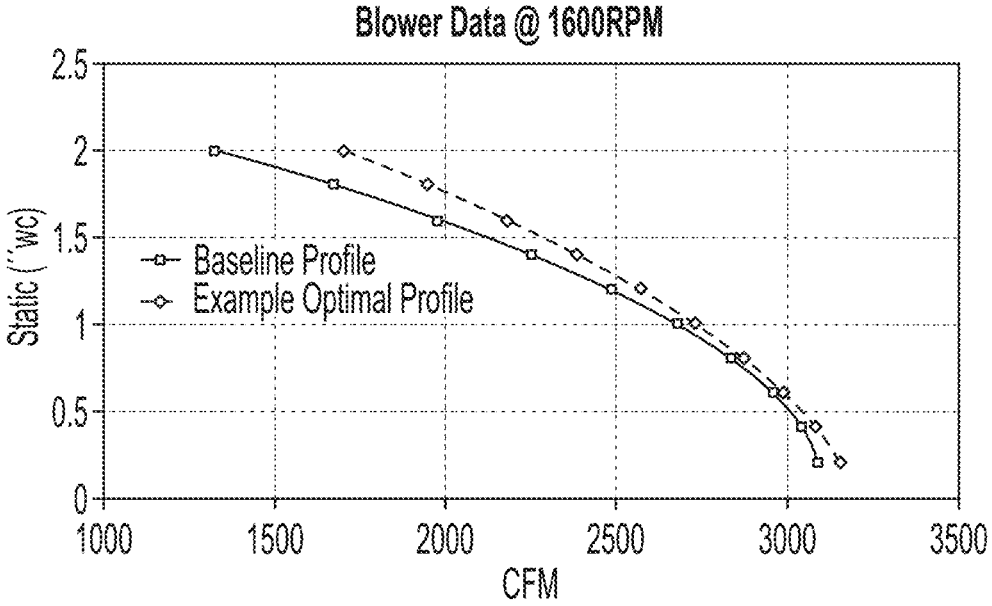
FIGS. 6A-B are graphs illustrating simulated performance of a blower.
Figure 6B:
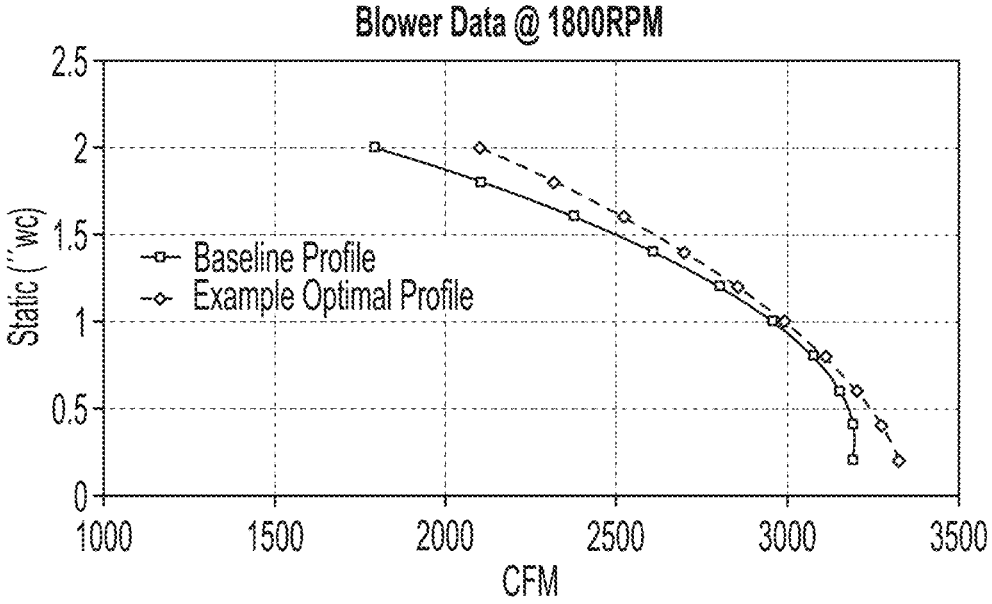

FIGS. 6A-B are graphs illustrating simulated performance of an example blower, such as blower 300 of FIG. 3, operating at 1600 revolutions per minute (RPM) and 1800 RPM, respectively. More particularly, FIGS. 6A-B each plot CFM versus static pressure (inches-water column) for each of a baseline housing profile and an example optimal housing profile. Generally, the baseline housing profile can correspond to an example housing profile that has not been optimized in the fashion described above relative to FIGS. 2A-C and 3. The example optimal housing profile can correspond to a housing profile that has been optimized, for example, according to Table 3 above. When FIGS. 4A-E, 5A-F, and 6A-B are viewed in combination, it can be seen that a housing profile with the example optimal profile can provide, for example, improved flow at higher static pressure as compared, for example, to the housing 202 shown in FIG. 2A.

Figure 7:
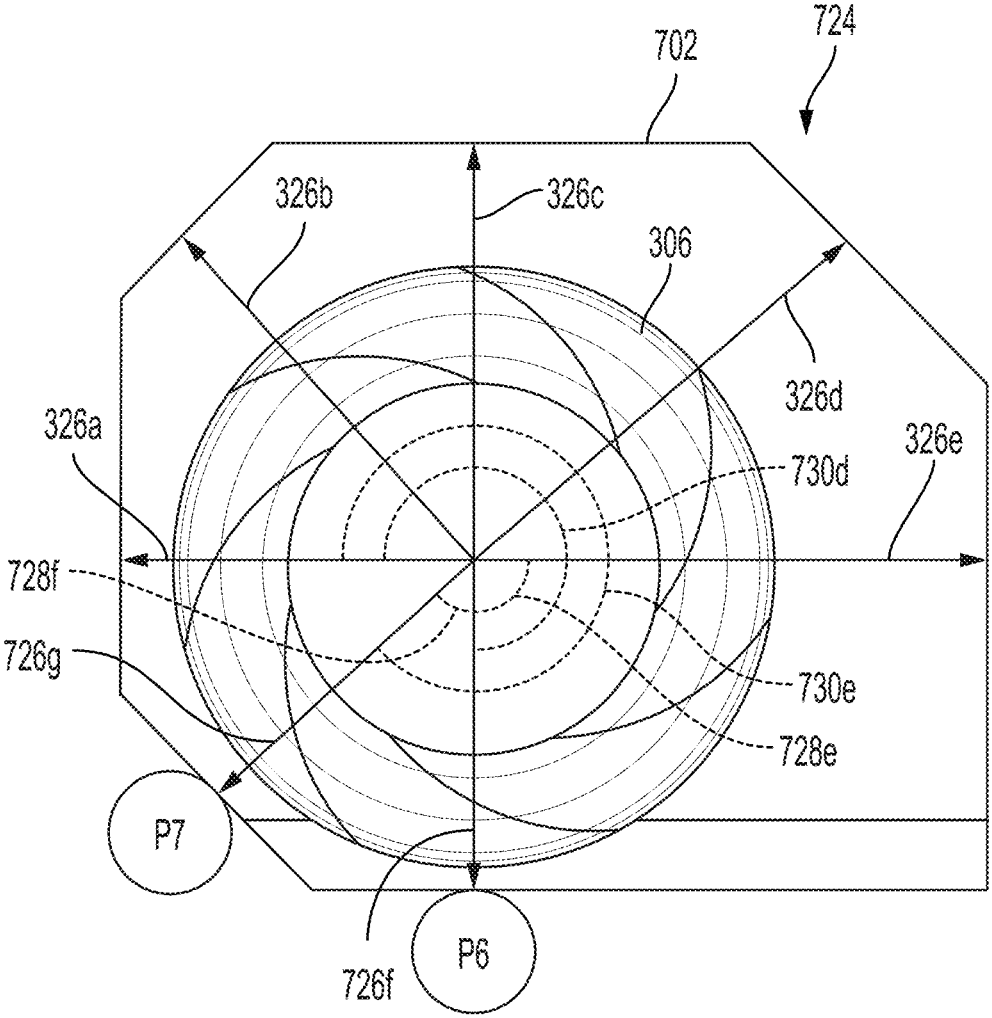
FIG. 7 illustrates a cross-sectional view of a blower.

FIG. 7 illustrates a cross-sectional view of a blower 700 from an intake side thereof. Blower 700 includes housing 702 and blower wheel 306 from FIG. 3. As illustrated, housing 702 forms cross-section 724 around at least a portion of the rotational plane of blower wheel 306.

More particularly, FIG. 7 illustrates distance parameters 326 from FIG. 3 along with distance parameters 726*f* and 726*g* (collectively, distance parameters 726). Distance parameters 726*f* and 726*g* are also referred to as P6 and P7, respectively. In contrast to the hexagonal shape of cross-section 324 of FIG. 3, cross-section 724 is a heptagonal shape such that each individual distance parameter of distance parameters 326 and 726 defines a distance measured radially outward from the center of blower wheel 306 to a different side of the heptagonal shape. Blower 700 can be configurably manufactured and/or assembled in accordance with distance parameters 326 in combination with distance parameters 726. In some embodiments, an outlet similar to outlet 210 can be disposed on a bottom of housing 702, such that the bottom is entirely or partially open beginning at approximately P6 and extending rightward to a right edge of the housing 702 and such that the bottom is closed from approximately P6 and extending leftward to a left edge of housing 702.

As with distance parameters 326, distance parameters 726 can be at least partially defined according to angles that are formed in cross-section 724. In the illustrated embodiment, distance parameter 726*f* forms an angle 728*e* with distance parameter 326*e* while distance parameter 726*g* forms an angle 728*f* with distance parameter 726*f* It should be appreciated that distance parameters 726*f* and 726*g* also each form an angle with distance parameter 326*a*. As shown, distance parameters 726*f* and 726*g* form cumulative angles 730*d* and 730*e*, respectively, with distance parameter 326*a*.

Angles 728*e* and 728*f* can be, for example, angles of the same or different sizes. In the example of FIG. 7, angle 728*e* is shown to be an approximately right angle (i.e., 90 degrees) and angle 728*f* is shown to be an acute angle of approximately 45 degrees. According to this example, cumulative angle 730*d* would be approximately 270 degrees and cumulative angle 730*e* would be approximately 315 degrees. One skilled in the art will appreciate that all angles shown in FIG. 7 can be configurably sized to suit a given implementation.

In similar fashion to the methods described relative to FIG. 3, in certain embodiments, distance parameters 326 and 726 can be configured as a function of the diameter of blower wheel 306. Table 4 below illustrates an example of ranges of values for distance parameters 326 and distance parameters 726 as a function of the diameter of blower wheel 306. Table 5 illustrates an example optimal profile for housing 702, where a specific formula is listed for each of distance parameters 326 and 726.

TABLE 4

| Parameter | Minimum | Maximum |
|---|---|---|
| P1 | 0.55 * Diameter | 0.57 * Diameter |
| P2 | 0.73 * Diameter | 0.75 * Diameter |
| P3 | 0.72 * Diameter | 0.8 * Diameter |
| P4 | 0.84 * Diameter | 0.86 * Diameter |
| P5 | 0.89 * Diameter | 0.91 * Diameter |
| P6 | 0.55 * Diameter | 0.57 * Diameter |
| P7 | 0.59 * Diameter | 0.61 * Diameter |

TABLE 5

| Example Optimal Profile | |
|---|---|
| Parameter | Value |
| P1 | 0.55 * Diameter |
| P2 | 0.73 * Diameter |
| P3 | 0.72 * Diameter |
| P4 | 0.84 * Diameter |
| P5 | 0.89 * Diameter |
| P6 | 0.55 * Diameter |
| P7 | 0.6 * Diameter |

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A blower for a heating, ventilation, and air conditioning system, the blower comprising:

a blower wheel comprising backward-curved blades configured to rotate in a rotational plane;

a housing forming a cross-section including more than six sides around at least a portion of the rotational plane, wherein the blower wheel is positioned within the housing such that there exists:

a first distance measured radially outward from a center of the blower wheel to a first side of the cross-section; and a second distance measured radially outward from the center of the blower wheel to a second side of the cross-section, wherein the second distance forms a first angle with the first distance; the first angle being an acute angle, and wherein the first distance and the second distance are unequal and less than a diameter of the blower wheel.

2. The blower of claim 1, wherein the first angle is approximately 45 degrees.

3. The blower of claim 1, wherein:

the first distance is approximately 0.55 to 0.57 times the diameter of the blower wheel; and the second distance is approximately 0.73 to 0.75 times the diameter of the blower wheel.

4. The blower of claim 1, wherein the blower wheel is positioned within the housing such that there exists a third distance measured radially outward from the center of the blower wheel to a third side of the cross-section, wherein the third distance forms a second angle with the first distance, the second angle being an approximately right angle that includes the first angle.

5. The blower of claim 4, wherein a third distance is approximately 0.72 to 0.8 times the diameter of the blower wheel.

6. The blower of claim 4, wherein the blower wheel is positioned within the housing such that there exists a fourth distance measured radially outward from the center of the blower wheel to a fourth side of the cross-section, wherein the fourth distance forms a third angle with the first distance, the third angle being an obtuse angle that includes the second angle.

7. The blower of claim 6, wherein the fourth distance is approximately 0.84 to 0.86 times the diameter of the blower wheel.

8. The blower of claim 6, wherein the third angle is approximately 135 degrees.

9. The blower of claim 6, wherein the blower wheel is positioned within the housing such that there exists a fifth distance measured radially outward from the center of the blower wheel to a fifth side of the cross-section, wherein the fifth distance forms a fourth angle with the first distance, and wherein the fourth angle is approximately 180 degrees and includes the third angle.

10. The blower of claim 9, wherein the fifth distance is approximately 0.89 to 0.91 times the diameter of the blower wheel.

11. The blower of claim 9, wherein:

the first distance is approximately 0.55 to 0.57 times the diameter of the blower wheel; and the second distance is approximately 0.73 to 0.75 times the diameter of the blower wheel;

the third distance is approximately 0.72 to 0.8 times the diameter of the blower wheel;

the fourth distance is approximately 0.84 to 0.86 times the diameter of the blower wheel; and the fifth distance is approximately 0.89 to 0.91 times the diameter of the blower wheel.

12. The blower of claim 9, wherein the blower wheel is positioned within the housing such that there exists a sixth distance measured radially outward from the center of the blower wheel to a sixth side of the cross-section, wherein the sixth distance forms a fifth angle with the first distance, and wherein the fifth angle includes the fourth angle.

13. The blower of claim 12, wherein the fifth angle is approximately 270 degrees.

14. The blower of claim 12, wherein the sixth distance is approximately 0.55 to 0.57 times the diameter of the blower wheel.

15. The blower of claim 12, wherein the blower wheel is positioned within the housing such that there exists a seventh distance measured radially outward from the center of the blower wheel to a seventh side of the cross-section, wherein the seventh distance forms a sixth angle with the first distance, and wherein the sixth angle includes the fifth angle.

16. The blower of claim 15, wherein the sixth angle is approximately 315 degrees.

17. The blower of claim 15, wherein the seventh distance is approximately 0.59 to 0.61 times the diameter of the blower wheel.

18. A method of assembling a blower, the method comprising:

providing a housing and a blower wheel, the blower wheel comprising backward-curved blades configured to rotate in a rotational plane; and positioning the blower wheel in the housing such that the housing forms a cross-section including more than six sides around at least a portion of the rotational plane such that there exists:

a first distance measured radially outward from a center of the blower wheel to a first side of the cross-section; and a second distance measured radially outward from the center of the blower wheel to a second side of the cross-section, wherein the second distance forms a first angle with the first distance; the first angle being an acute angle, and wherein the first distance and the second distance are unequal and less than a diameter of the blower wheel.

19. A heating, ventilation, and air conditioning system, comprising:

an evaporator coil;

a blower coupled to the evaporator coil, the blower comprising:

a blower wheel comprising backward-curved blades configured to rotate in a rotational plane;

a housing forming a cross-section including more than six sides around at least a portion of the rotational plane, wherein the blower wheel is positioned within the housing such that there exists:

a first distance measured radially outward from a center of the blower wheel to a first side of the cross-section; and a second distance measured radially outward from the center of the blower wheel to a second side of the cross-section, wherein the second distance forms a first angle with the first distance; the first angle being an acute angle, and wherein the first distance and the second distance are unequal and less than a diameter of the blower wheel.

20. The heating, ventilation, and air conditioning system of claim 19, wherein the blower wheel is positioned within the housing such that there exists:

a third distance measured radially outward from the center of the blower wheel to a third side of the cross-section, wherein the third distance forms a second angle with the first distance, the second angle being an approximately right angle that includes the first angle;

a fourth distance measured radially outward from the center of the blower wheel to a fourth side of the cross-section, wherein the fourth distance forms a third angle with the first distance, the third angle being an obtuse angle that includes the second angle;

a fifth distance measured radially outward from the center of the blower wheel to a fifth side of the cross-section, wherein the fifth distance forms a fourth angle with the first distance, and wherein the fourth angle is approximately 180 degrees and includes the third angle;

a sixth distance measured radially outward from the center of the blower wheel to a sixth side of the cross-section, wherein the sixth distance forms a fifth angle with the first distance, and wherein the fifth angle includes the fourth angle; and a seventh distance measured radially outward from the center of the blower wheel to a seventh side of the cross-section, wherein the seventh distance forms a sixth angle with the first distance, and wherein the sixth angle includes the fifth angle.

* * * * *